US005832536A

United States Patent [19]

Kramer

[11] Patent Number: 5,832,536

[45] Date of Patent: Nov. 10, 1998

[54] HOLSTER UNDERSHIRT

[75] Inventor: Gregory W. Kramer, Puyallup, Wash.

[73] Assignee: Kramer Handgun Leather, Inc., Tacoma, Wash.

[21] Appl. No.: 610,081

[22] Filed: Feb. 29, 1996

[51] Int. Cl.[6] ..... A41B 1/00

[52] U.S. Cl. ..... 2/69; 2/115; 2/247

[58] Field of Search ..... 2/69, 113, 115, 2/94, 108, 102, 105, 106, 247–250, 251, 252; 224/911, 912, 271, 272, 901, 252

[56] References Cited

U.S. PATENT DOCUMENTS

| | | | |
|---|---|---|---|
| D. 234,840 | 4/1975 | Adams | 2/102 X |
| 3,797,715 | 3/1974 | Scialdone | 224/911 |
| 4,235,356 | 11/1980 | Atchisson | 224/911 |
| 4,262,832 | 4/1981 | Perkins | 224/911 |
| 4,903,874 | 2/1990 | Shoemaker | 224/911 |
| 5,067,642 | 11/1991 | Fodge | 224/911 |
| 5,465,429 | 11/1995 | Rogers et al. | 224/911 |

*Primary Examiner*—C. D. Crowder
*Assistant Examiner*—Gloria Hale
*Attorney, Agent, or Firm*—Jensen & Puntigam, PS

[57] ABSTRACT

A substantially unitary undergarment covering the majority of the upper body which includes an integral holster beneath the arm of the wearer and includes stitching and straps to secure the weapon in a concealed fashion adjacent the body and ready for use. The garment could include means to shield the weapon from perspiration.

2 Claims, 3 Drawing Sheets

HOLSTER UNDERSHIRT

TECHNICAL FIELD

This invention relates to undergarments and more particularly to a pullover-type shirt designed to be worn beneath an outer shirt, wherein the undergarment is fabricated of a breathable fabric and includes a holster for a weapon located generally beneath the armhole thereof.

BACKGROUND OF THE INVENTION

It is well known that police officers are often required to carry their weapons when they are off duty, and further that there are several segments of the enforcement or security society which are required to carry weapons but do not wish to have the general public know or have it be readily obvious that the weapons are being carried. It is well known that guns are often carried strapped to the legs of officers as well as under the arms of officers. The devices used to holster these weapons in the past have suffered from inadequacies, including the fact that the holster shifts when the person is trying to reach the weapon, the straps which support the weapon are uncomfortable, and further because of the fact that the holsters are bulky, a close observer can readily detect that the person is wearing a weapon.

Accordingly, it is the intent of the present invention to provide a garment which, while providing secure support for a weapon, carries the weapon hidden from view, is comfortable for the person wearing it, and the fact that a weapon is carried is not readily obvious to any except the extremely careful observer.

Prior art known to the inventor includes U.S. Design Pat. No. 214,560 granted to Kassel on Jul. 1, 1969, which discloses an undercover small arms shoulder holster.

U.S. Design Pat. No. 234,840 granted to Adams in 1975 discloses a vest-like garment for carrying a weapon in a holster, handcuffs and extra cartridges.

U.S. Pat. No. 4,262,832 granted to Perkins on Apr. 21, 1981 discloses a vest-type garment including a pocket for carrying a concealed weapon, wherein the holster is detachable from the garment.

U.S. Pat. No. 4,369,526 granted to Clutts on Jan. 25, 1995 discloses a utility vest which has a separate utility apron spreading the weight of the tools over a larger area of the body.

U.S. Pat. No. 4,453,274 granted to Allen on Jun. 12, 1984 discloses a two-part athletic vest such that the color exposed may be quickly and easily changed without removal of the vest.

U.S. Pat. No. 4,796,304 granted to Shelby on Jan. 10, 1989 discloses a ventilated hunting vest which has a mesh material secured over the exterior portion thereof forming large ventilated pockets for containing food, game or the like.

U.S. Pat. No. 4,882,786 granted to Gross on Nov. 28, 1989 discloses a specialized vest including a pocket for supporting the arm of the wearer when he is carrying a rifle or a shotgun.

U.S. Pat. No. 4,903,874 granted to Shoemaker on Feb. 27, 1990 discloses a shoulder holster including interconnecting straps.

U.S. Pat. No. 4,998,654 granted to Bruzek et al on Mar. 12, 1991 discloses an article carrier vest with means to attach carrier bags.

U.S. Pat. No. 5,031,244 granted to Inagaki on Jul. 16, 1991 discloses a garment made of a mesh material and including a folded portion at the bottom on the vest to hold one or more heating devices.

U.S. Pat. No. 5,127,565 granted to Grant on Jul. 7, 1992 discloses an ammunition dispensing garment.

U.S. Pat. No. 5,265,782 granted to McNamara on Nov. 30, 1993 discloses a military medical vest wherein the vest accommodates the supplies and paraphernalia typically used by a military medic.

DISCLOSURE OF THE INVENTION

With the above-noted prior art and problems in mind, it is the object of the present invention to provide a garment that may be comfortable worn and wherein said garment is designed to support a weapon and when covered by an outer garment makes the fact that the person is carrying a weapon unknown to any but the most careful observer.

It is another object of the present invention to provide a garment which can be worn in a wide variety of climates, support a weapon, and be comfortable to the wearer.

It is still another object of the present invention to provide an undergarment which is simple in design, inexpensive to manufacture, and yet is comfortable and convenient for the wearer and maintains the weapon in a secure but accessible location.

Yet another object of the present invention is that it may be configured in several styles and yet renders the fact that a gun is being carried difficult to detect under a great variety of clothing, formal to sport.

BEST MODE FOR CARRYING OUT THE INVENTION

Figure 1:
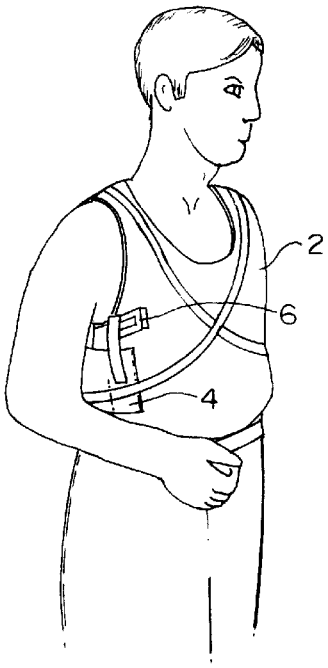
FIG. 1 is a pictorial representation of a person wearing the inventive garment.

As seen in FIG. 1, the present invention comprises an undergarment 2 including an integral undergarment holster 4, to be described in greater detail hereinafter, which supports a weapon 6. As is obvious, the undergarment 2 is to be worn beneath another garment.

Figure 2:
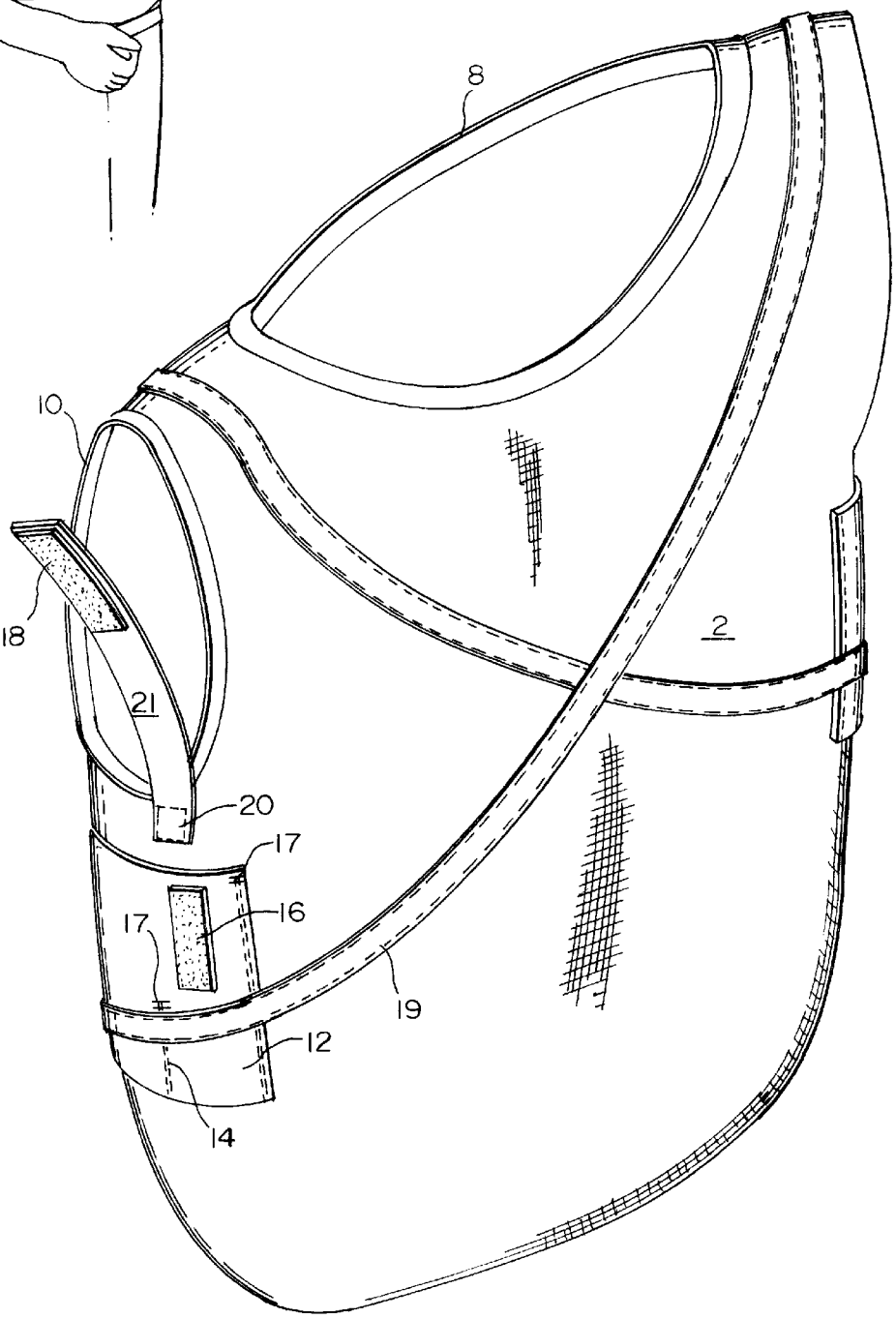
FIG. 2 is a perspective view of the undergarment including a holster.

Referring now to FIG. 2, the undergarment includes the normal neck opening 8 which could be of any one of a number of different configurations, including the standard T-shirt, turtleneck or indeed could in fact include a scoop neck. The garment also has a pair of opposing arm openings 10, and mounted beneath one or both of the arm openings would be a holster which comprises a rectangular piece of a surgical elastic material of sufficient resilience to support the weapon. The material 12 is stitched to the undergarment 2 along its vertical edges and includes a dividing stitch line 14 at the center to support the barrel of the weapon and serve as a stop for the trigger guard. It is to be understood that it is recognized that the weight of the weapon places additional stress on the stitching and therefore reinforcing stitches such as double bar tacks 17 will often be used. Also seen in this view is an X-configured reinforcing strip 19 which serves to hold the gun against the body.

Secured to the exterior of the patch 12 is a Velcro strip 16 which mates with the opposite strip 18 on a strap which is secured to the exterior of the garment as at 20. It is to be noted that the securement means 20 is exterior of the garment for comfort and could be stitched in place or could also be secured by hook and loop fasteners. In use, the gun is placed in the holster with the handle extending towards the hand the wearer normally uses to shoot the gun (in normal operation, one would come across the body to draw the gun, i.e. the opposite hand) and the strap is secured to keep the gun both secure in the holster and to hold the butt adjacent the body. The weapon is concealed adjacent the body of the wearer and beneath the arm.

Figure 3:
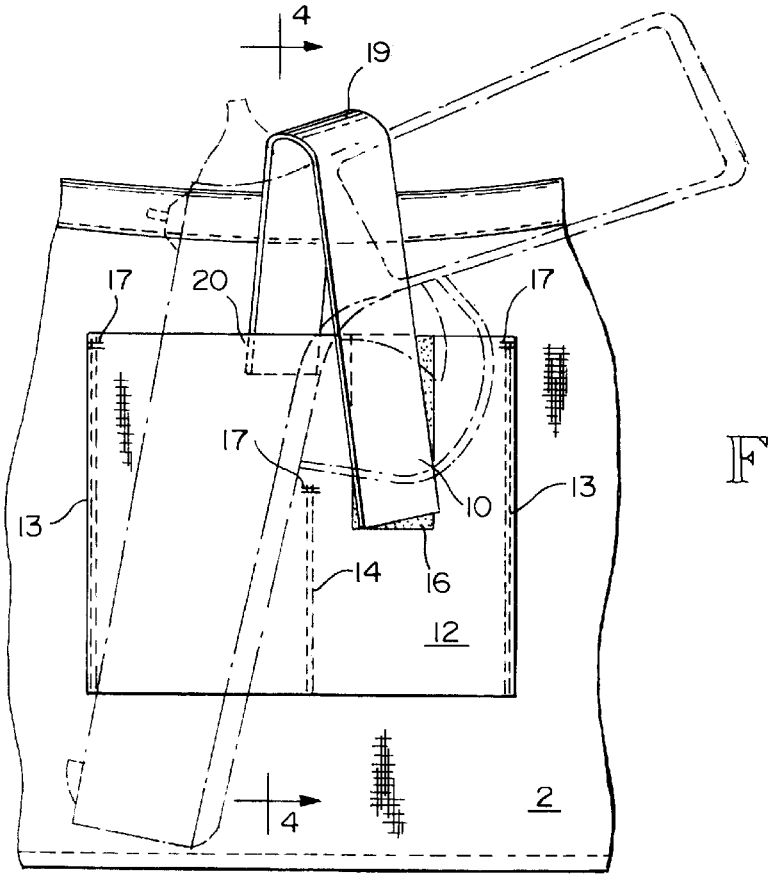
FIG. 3 is an enlarged view of the holster portion of the undergarment.
Figure 4:
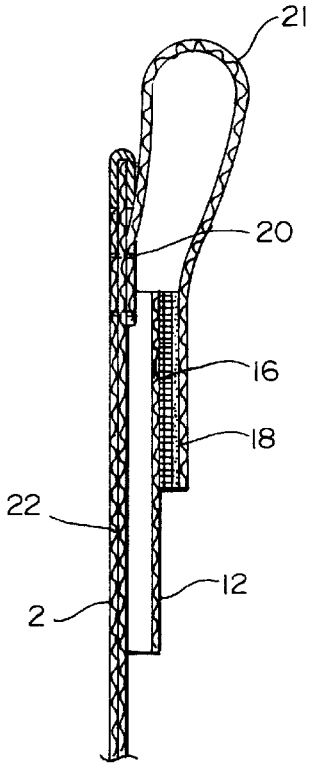
FIG. 4 is a vertical section along lines 4,4 of FIG. 3.

As seen in FIGS. 3 and 4, the holster 12 is secured to the undergarment 2 by means of double stitching 13 at its opposite vertical edges and divided by double stitching 14 at the center to support the trigger guard of the weapon. It is to be noted that there is a double bar tack 17 at the upper end of each of the double stitching.

In FIG. 4, it can be seen that a piece of cloth 22 is located between the undergarment material 2 and the weapon, and it is to be understood that this cloth is breathable but generally water-impermeable such that the perspiration from the person wearing the gun will not be transferred to the gun to corrode the weapon.

It is to be understood that the garment could also include a fastening strap or elastic strip at the back to assure a more tight fit to the torso. It is also to be understood that the shirt would be breathable material which is designed for coolness and to wick moisture away from the body. It is contemplated that there would be a portion of the shirt which would be manufactured or include some Gore-Tex type material to prevent undue body moisture from corroding the weapon.

It is further to be understood that the entire garment could be manufactured of soft body armor or patches of soft body armor could be applied or placed in pockets covering vital areas of the torso.

Referring now to FIG. 3, the stitching 14 and 13 can more easily be seen with the weapon in place and the strap 19 being secured.

Figure 5:
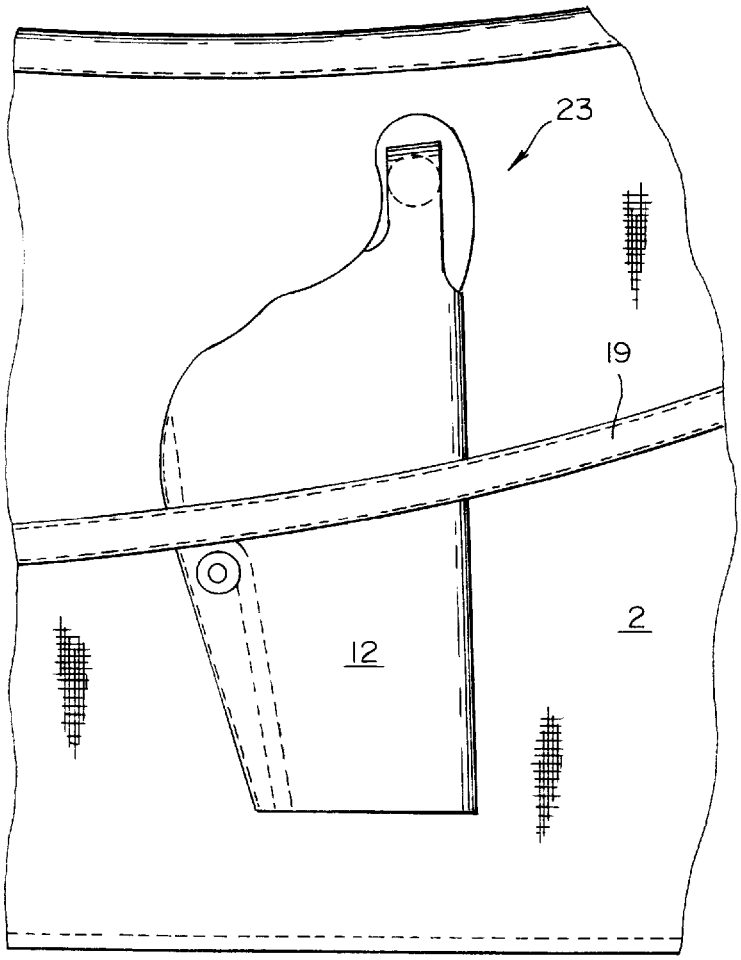
FIG. 5 is a different style holster incorporated into the inventive vest.

The garment as seen in FIG. 5 is identical to that previously described, except that it includes a "thumb break" 23. A portion 25 of the gun-receiving member 12 is removed for greater ease of removal of the gun.

Thus it can be seen that the present invention contemplates an inexpensive and comfortable garment which supports a pistol in a secure place beneath the arm of the wearer wherein it cannot be easily detected, the holster allows for quick release of the weapon and yet assures that the weapon is held closely to the body to prevent detection while protecting the weapon from undue exposure to perspiration.

I claim:

1. A device for carrying a concealed weapon, comprising:

a unitary garment including a front, a back, an upper portion, a lower portion, an exterior and interior, a hole at the upper portion to allow passage of the wearer's head and surround the neck when in use, and a pair of arm holes on opposite sides of the garment which in conjunction with the hole in the upper portion form a pair of unitary straps to extend over the wearer's shoulders;

a gun receiving pocket directly below at least one of the arm holes, said pocket comprising a piece of material having a pair of parallel edges and a bottom secured to the exterior of the garment, the securement comprising a pair of parallel vertical stitch lines along the edges of the material in a top to bottom direction, and a third intermediate parallel stitch line extending from the bottom of the material to a point intermediate the length of the pair of stitched lines creating a vertical opening to receive the barrel of a gun and a closed portion to support the trigger guard; and a strap releasably secured to the garment, extending over the handle of the gun to secure the weapon in place whereby the gun can be carried beneath other clothing without revealing straps, and further, the weight of the gun is more evenly distributed over the torso of the wearer.

2. A device as in claim 1 and further including at least one reinforcing strip which extends over the exterior of the gun receiving pocket to provide additional support.

* * * * *